US009428321B2

(12) United States Patent
Stahl

(10) Patent No.: US 9,428,321 B2
(45) **Date of Patent: *Aug. 30, 2016**

(54) BEVERAGE CRATE WITH CONSTANT-DIAMETER POCKETS

(71) Applicant: Orbis Canada Limited, Toronto (CA)

(72) Inventor: Edward L. Stahl, Tyler, TX (US)

(73) Assignee: Orbis Canada Limited, Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/302,718

(22) Filed: Jun. 12, 2014

(65) Prior Publication Data

US 2014/0291185 A1 Oct. 2, 2014

Related U.S. Application Data

(63) Continuation of application No. 12/856,085, filed on Aug. 13, 2010, now Pat. No. 8,757,420, which is a continuation of application No. 12/141,582, filed on Jun. 18, 2008, now Pat. No. 7,793,783.

(51) Int. Cl.

| | |
|---|---|
| ***B65D 1/24*** | (2006.01) |
| ***B65D 1/36*** | (2006.01) |
| ***B65D 85/30*** | (2006.01) |

(52) U.S. Cl.

CPC ..... *B65D 85/305* (2013.01); *B65D 1/243* (2013.01); *B65D 2501/2407* (2013.01); *B65D 2501/24019* (2013.01); *B65D 2501/2435* (2013.01);

(Continued)

(58) Field of Classification Search

CPC ..... B65D 1/243; B65D 2501/24108; B65D 2501/2435

USPC ..... 220/509, 513, 516–519; 206/204, 427

See application file for complete search history.

(56) References Cited

U.S. PATENT DOCUMENTS

| | | | |
|---|---|---|---|
| D98,200 | S | 1/1936 | Worthington |
| 2,535,493 | A | 12/1950 | Gerber |

(Continued)

FOREIGN PATENT DOCUMENTS

| | | |
|---|---|---|
| AU | 247904 | 8/1962 |
| CA | 965056 A1 | 3/1975 |

(Continued)

OTHER PUBLICATIONS

International Preliminary Report on Patentability for PCT/Us2008/078177 mailed Mar. 30, 2010 (1 page).

(Continued)

*Primary Examiner* — Shawn M Braden

(74) *Attorney, Agent, or Firm* — Nixon Peabody LLP

(57) ABSTRACT

A nestable crate or container for holding bottles. The crate has a floor portion substantially in a first plane having a plurality of bottle seating areas, with each bottle seating area being adapted to receive a lower portion of a bottle. The crate also includes a peripheral wall surrounding the floor portion and extending upward from the floor portion, a plurality of central columns extending upward from the floor portion and oriented proximate to a longitudinal centerline of the crate, and a plurality of pylons extending upward from the floor portion along the periphery of the crate. Each central column includes at least one first bottle-contacting surface and each pylon includes at least one second bottle-contacting surface. Both the first and second bottle contacting surfaces are substantially orthogonal to the first plane.

20 Claims, 8 Drawing Sheets

(52) U.S. Cl.
CPC ..... *B65D2501/24108* (2013.01); *B65D 2501/24127* (2013.01); *B65D 2501/24152* (2013.01); *B65D 2501/24235* (2013.01); *B65D 2501/24267* (2013.01); *B65D 2501/24299* (2013.01); *B65D 2501/24541* (2013.01); *B65D 2501/24713* (2013.01); *B65D 2501/24719* (2013.01)

(56) References Cited

U.S. PATENT DOCUMENTS 2,619,251 A 11/1952 Schmidt
2,743,030 A 4/1956 Read, Jr.
2,760,676 A 8/1956 Knierien et al.
2,970,715 A 2/1961 Kappel et al.
3,092,284 A 6/1963 Stout
3,106,308 A 10/1963 Kazimier
3,151,762 A 10/1964 Vidal
3,247,996 A 4/1966 Garcia
3,326,410 A 6/1967 Asenbauer
3,333,727 A 8/1967 Belcher et al.
D208,673 S 9/1967 Adomat
3,347,405 A 10/1967 Motsenbocker et al.
3,349,943 A 10/1967 Box
3,361,292 A 1/1968 Huisman
3,363,802 A 1/1968 Cornelius
3,376,998 A 4/1968 Cornelius
3,384,261 A 5/1968 Austin
3,390,808 A 7/1968 Rehrig et al.
3,391,814 A 7/1968 Box
3,391,815 A 7/1968 Box
3,392,869 A 7/1968 Box
3,416,694 A 12/1968 Bebb
3,419,182 A 12/1968 Gildart
3,506,154 A 4/1970 Barnes
D217,901 S 6/1970 Rehrig, H.
3,517,852 A 6/1970 Schoeller
3,565,278 A 2/1971 Rehrig et al.
3,628,684 A 12/1971 Sere
D229,672 S 12/1973 Van Geem
3,791,549 A 2/1974 Delbrouck et al.
3,812,996 A 5/1974 Bunnell
3,919,379 A 11/1975 Smarook
3,997,074 A 12/1976 Shead
4,101,049 A 7/1978 Wallace et al.
4,105,117 A 8/1978 Atkin et al.
4,161,259 A 7/1979 Palafox
4,162,738 A 7/1979 Wright
D252,961 S 9/1979 Carroll et al.
D254,423 S 3/1980 Van Geem
4,204,596 A 5/1980 Davis
4,319,685 A 3/1982 David
4,410,099 A 10/1983 deLarosiere
D273,523 S 4/1984 DiSesa
D273,524 S 4/1984 DiSesa
D275,142 S 8/1984 Torokvei
4,538,742 A 9/1985 Prodel
4,588,087 A 5/1986 Swingley, Jr.
D284,841 S 7/1986 Rowland et al.
D284,898 S 7/1986 Graham
4,619,371 A 10/1986 Rehrig
D286,936 S 11/1986 Bitel, Sr.
D289,938 S 5/1987 Warwick
4,700,836 A 10/1987 Hammett
4,700,837 A 10/1987 Hammett
4,722,440 A 2/1988 Johnston
4,759,451 A 7/1988 Apps
4,773,554 A 9/1988 Warwick
4,789,063 A 12/1988 Hammett
D302,897 S 8/1989 Shchamorov et al.
D304,123 S 10/1989 Warwick
4,899,874 A 2/1990 Apps et al.
4,928,841 A 5/1990 Arthurs
4,932,532 A 6/1990 Apps et al.
4,944,400 A 7/1990 Van Onstein et al.
4,978,002 A 12/1990 Apps et al.
D313,493 S 1/1991 Apps et al.
5,009,053 A 4/1991 Langenbeck et al.
D317,670 S 6/1991 Apps
D318,552 S 7/1991 Apps
5,031,761 A 7/1991 deLarosiere
5,035,326 A 7/1991 Stahl
D319,129 S 8/1991 Apps et al.
5,038,961 A 8/1991 Watanabe et al.
5,060,819 A 10/1991 Apps
5,071,026 A 12/1991 Apps
D325,279 S 4/1992 Apps
5,105,948 A 4/1992 Morris et al.
D326,346 S 5/1992 Osakada
5,115,937 A 5/1992 Chausse et al.
D327,357 S 6/1992 Rehrig
D327,970 S 7/1992 Watanabe et al.
D327,972 S 7/1992 Apps et al.
D329,931 S 9/1992 Apps
D329,932 S 9/1992 Apps
D330,621 S 10/1992 Apps
5,184,748 A 2/1993 Apps
5,213,211 A 5/1993 Umiker
5,230,601 A 7/1993 Apps et al.
5,267,649 A 12/1993 Apps et al.
5,277,316 A 1/1994 Apps et al.
5,285,899 A 2/1994 Apps et al.
5,305,884 A 4/1994 Apps et al.
5,316,172 A 5/1994 Apps et al.
5,316,173 A 5/1994 Emery
D348,344 S 6/1994 Apps
5,323,925 A 6/1994 Apps
5,335,814 A 8/1994 Hepp
5,351,814 A 10/1994 Apps
5,372,257 A 12/1994 Beauchamp et al.
5,377,862 A 1/1995 Oakes et al.
5,379,905 A 1/1995 Bustos et al.
D355,764 S 2/1995 Apps
D356,211 S 3/1995 Apps et al.
D356,679 S 3/1995 Apps
5,405,042 A 4/1995 Apps et al.
5,426,890 A 6/1995 Dummen
D361,431 S 8/1995 Koefelda
D361,663 S 8/1995 Kalin
5,445,273 A 8/1995 Apps
5,465,843 A 11/1995 Koefelda
D365,446 S 12/1995 Raghunathan
5,487,487 A 1/1996 Hammett
5,495,945 A 3/1996 Apps et al.
5,501,352 A 3/1996 Apps
5,529,176 A 6/1996 Apps et al.
5,575,390 A 11/1996 Apps et al.
D378,249 S 3/1997 Apps et al.
D379,121 S 5/1997 Apps et al.
D379,717 S 6/1997 Apps et al.
D380,613 S 7/1997 Apps et al.
D380,901 S 7/1997 Apps et al.
5,651,461 A 7/1997 Apps et al.
5,660,279 A 8/1997 Apps et al.
5,704,482 A 1/1998 Apps et al.
5,752,602 A 5/1998 Ackermann et al.
D395,954 S 7/1998 Apps et al.
5,785,170 A 7/1998 Hammett
D399,060 S 10/1998 Apps et al.
D399,061 S 10/1998 Apps et al.
D400,012 S 10/1998 Apps
5,823,376 A 10/1998 McGrath
5,826,742 A 10/1998 Timpert
D401,764 S 12/1998 Apps et al.
5,842,572 A 12/1998 Apps et al.
D403,895 S 1/1999 Beggs
5,855,277 A 1/1999 Apps et al.
D412,399 S 8/1999 Apps et al.
5,979,654 A 11/1999 Apps
D417,784 S 12/1999 Umiker
6,006,912 A 12/1999 McGrath
D420,220 S 2/2000 Apps et al.
6,021,913 A 2/2000 McGrath
6,047,844 A 4/2000 McGrath
6,073,793 A 6/2000 Apps et al.

(56) References Cited

U.S. PATENT DOCUMENTS

| | | | | |
|---|---|---|---|---|
| 6,131,730 | A | 10/2000 | Hsu | |
| 6,186,328 | B1 | 2/2001 | Apps | |
| 6,237,758 | B1 | 5/2001 | Hsu | |
| D445,253 | S | 7/2001 | Hammett | |
| D452,613 | S | 1/2002 | Hammett | |
| 6,401,960 | B1 * | 6/2002 | Hammett | 220/516 |
| D461,054 | S | 8/2002 | Hammett | |
| D461,957 | S | 8/2002 | Hammett | |
| D462,522 | S | 9/2002 | Apps et al. | |
| 6,454,120 | B1 * | 9/2002 | Hammett | 220/515 |
| 6,457,599 | B1 | 10/2002 | Apps et al. | |
| D468,634 | S | 1/2003 | Hammett | |
| D469,255 | S | 1/2003 | Hammett | |
| D487,634 | S | 3/2004 | Apps et al. | |
| 6,892,885 | B2 | 5/2005 | Apps et al. | |
| 6,899,247 | B1 | 5/2005 | Koefelda et al. | |
| D507,880 | S | 8/2005 | Hassell et al. | |
| 6,966,442 | B2 | 11/2005 | Hassell et al. | |
| 7,017,746 | B2 | 3/2006 | Apps | |
| 7,036,666 | B2 | 5/2006 | Hammett | |
| 7,086,531 | B2 | 8/2006 | Apps et al. | |
| 7,093,715 | B1 | 8/2006 | Apps | |
| 7,097,033 | B2 * | 8/2006 | Koefelda | B65D 1/243 206/427 |
| 7,128,234 | B2 | 10/2006 | Apps et al. | |
| 7,281,641 | B2 | 10/2007 | Apps | |
| 7,578,410 | B2 | 8/2009 | Stahl et al. | |
| 7,735,676 | B2 | 6/2010 | Ogburn | |
| 7,743,939 | B2 | 6/2010 | Stahl | |
| 7,793,783 | B2 | 9/2010 | Stahl | |
| 8,757,420 | B2 | 6/2014 | Stahl | |
| 8,893,891 | B2 * | 11/2014 | Apps | 206/509 |
| 2001/0015329 | A1 | 8/2001 | Apps et al. | |
| 2001/0019063 | A1 | 9/2001 | Apps | |
| 2002/0195452 | A1 | 12/2002 | Apps | |
| 2003/0029870 | A1 | 2/2003 | Apps et al. | |
| 2003/0057211 | A1 | 3/2003 | Koefelda et al. | |
| 2003/0075546 | A1 | 4/2003 | Hammett | |
| 2005/0040069 | A1 | 2/2005 | Apps et al. | |
| 2005/0057314 | A1 | 3/2005 | Hsu et al. | |
| 2007/0095844 | A1 | 5/2007 | Raghunathan | |
| 2007/0246392 | A1 | 10/2007 | Stahl | |
| 2009/0206088 | A1 | 8/2009 | Ogburn | |

FOREIGN PATENT DOCUMENTS

| | | | |
|---|---|---|---|
| CA | 2377480 | A1 | 12/2002 |
| CA | 2669586 | A1 | 12/2009 |
| DE | 1883773 | U | 11/1963 |
| DE | 3801224 | A1 | 4/1989 |
| DE | 102004023044 | A1 | 11/2005 |
| FR | 1518610 | A | 3/1968 |
| GB | 0933480 | A | 8/1963 |
| GB | 1032916 | A | 6/1966 |
| WO | 9411255 | A1 | 5/1994 |

OTHER PUBLICATIONS

International Search Report for PCT/US2008/078177 mailed Jan. 12, 2009 (3 pages).

Written Opinion of International Searching Authority for PCT/US2008/078177 mailed Mar. 27, 2010 (5 pages).

Photographs of bottle crate made by Rehrig Pacific Company and located in Mexico; date unknown (3 pages).

* cited by examiner

BEVERAGE CRATE WITH CONSTANT-DIAMETER POCKETS

CROSS-REFERENCE TO RELATED APPLICATIONS

This application is a continuation of and claims priority from U.S. application Ser. No. 12/856,085, which was filed on Aug. 13, 2010, which is a continuation of U.S. application Ser. No. 12/141,582, which was filed on Jun. 18, 2008, now issued as U.S. Pat. No. 7,793,783.

BACKGROUND OF THE INVENTION

1. Field of the Invention

The present invention relates to a stackable crate for holding beverage bottles. Particularly, the present invention is directed to a stackable crate that includes constant diameter pockets for receiving and securely holding beverage bottles.

2. Description of Related Art

Beverages such as soft drinks are typically packaged in plastic bottles. Polyethylene terephthalate (PET) is a favored material for such bottles due to its high strength, flexibility, and low cost. Conventional PET bottles, when filled with a beverage, can bear high compressive loads up to many times the total weight of the bottle and beverage, provided that the load is distributed along the symmetry axis of the bottle and provided that the bottle is maintained in a sufficiently upright position. However, when an off-axis compressive load is applied to the bottles, they have a tendency to buckle.

A variety of cases used for shipping and storing beverage bottles are known in the art. Typically, the cases are stacked on top of each other on pallets where they can then be loaded onto trucks or other means of transportation and shipped to a bottler. The bottler then loads each case with several bottles and then stacks the cases one on top of the other so that the cases can be shipped to retailers. Conventional bottle cases are typically low depth cases with four side walls, a flat bottom portion, and a number of upwardly projecting columns. The columns, walls, and bottom portion define a bottle-retaining pocket. Typically, the columns of conventional cases are hollow, angled toward the interior of the crate, and tapered to be smaller in cross section at the top and larger near the bottom, which facilitates stacking of the cases. These conventional cases generally have been considered satisfactory for their intended purpose.

However, these conventional low depth cases with tapered columns may not provide sufficient support to the bottles to allow the cases to be stacked in a stable and secure manner. There remains a need in the art for a beverage case that is capable of securely holding a wide variety of bottles so that the cases can be stacked and shipped safely. The present invention provides a solution to these problems.

SUMMARY OF THE INVENTION

Advantages of the present invention will be set forth in and become apparent from the description that follows. Additional advantages of the invention will be realized and attained by the beverage crate particularly pointed out in the written description and claims, as well as from the appended drawings.

To achieve these and other advantages and in accordance with the purpose of the invention, as embodied herein, the invention includes a nestable crate or container for holding bottles. The crate has a floor portion substantially in a first plane having a plurality of bottle seating areas, with each bottle seating area being adapted to receive a lower portion of a bottle. The crate also includes a peripheral wall surrounding the floor portion and extending upward from the floor portion, a plurality of central columns extending upward from the floor portion and oriented proximate to a longitudinal centerline of the crate, and a plurality of pylons extending upward from the floor portion along the periphery of the crate. At least one central column includes at least one first bottle-contacting surface and at least one pylon includes at least one second bottle-contacting surface. Both the first and second bottle contacting surfaces are substantially orthogonal to the first plane.

The crate may also be cross-stackable. The cross-stackable crate includes a floor portion having a plurality of bottle seating areas, each bottle seating area having a substantially flat portion being adapted to receive a lower portion of a bottle. A top surface of the flat portion of each bottle seating area lies in a first plane. A peripheral wall surrounds the floor portion and extends upward from the floor portion. The peripheral wall includes a top portion forming a ledge for receiving a lower portion of a peripheral wall of a second crate. The crate also includes a plurality of hollow central columns oriented along a longitudinal centerline of the container and extending upward from the floor portion with each central column including a plurality of first bottle-contacting surfaces orthogonal to the first plane. A plurality of hollow pylons extend upward from the floor portion along the periphery of the container, the pylons including an inwardly angled exterior surface and a second bottle-contacting surface. The second bottle-contacting surface is orthogonal to the first plane and comprises a rib extending along a portion of the axial length of the pylon. The rib is surrounded by a plurality of grooves. The crate also includes a plurality of circular pockets for securely receiving a bottle, with the pockets being defined by at least one first bottle contacting surface on a central column and at least one second bottle contacting surface on a pylon. The circular pocket has a substantially constant diameter. A channel extends across the width of the container in a direction perpendicular to the longitudinal centerline and bisects the container into two substantially identical portions.

The foregoing summary of the invention and the following detailed description are exemplary and are intended to provide further explanation of the invention claimed. The accompanying drawings, which are incorporated in and constitute part of this specification, are included to illustrate and provide further understanding of the invention. Together with the description, the drawings serve to explain principles of the invention.

DETAILED DESCRIPTION OF THE PREFERRED EMBODIMENTS

Figure 1:
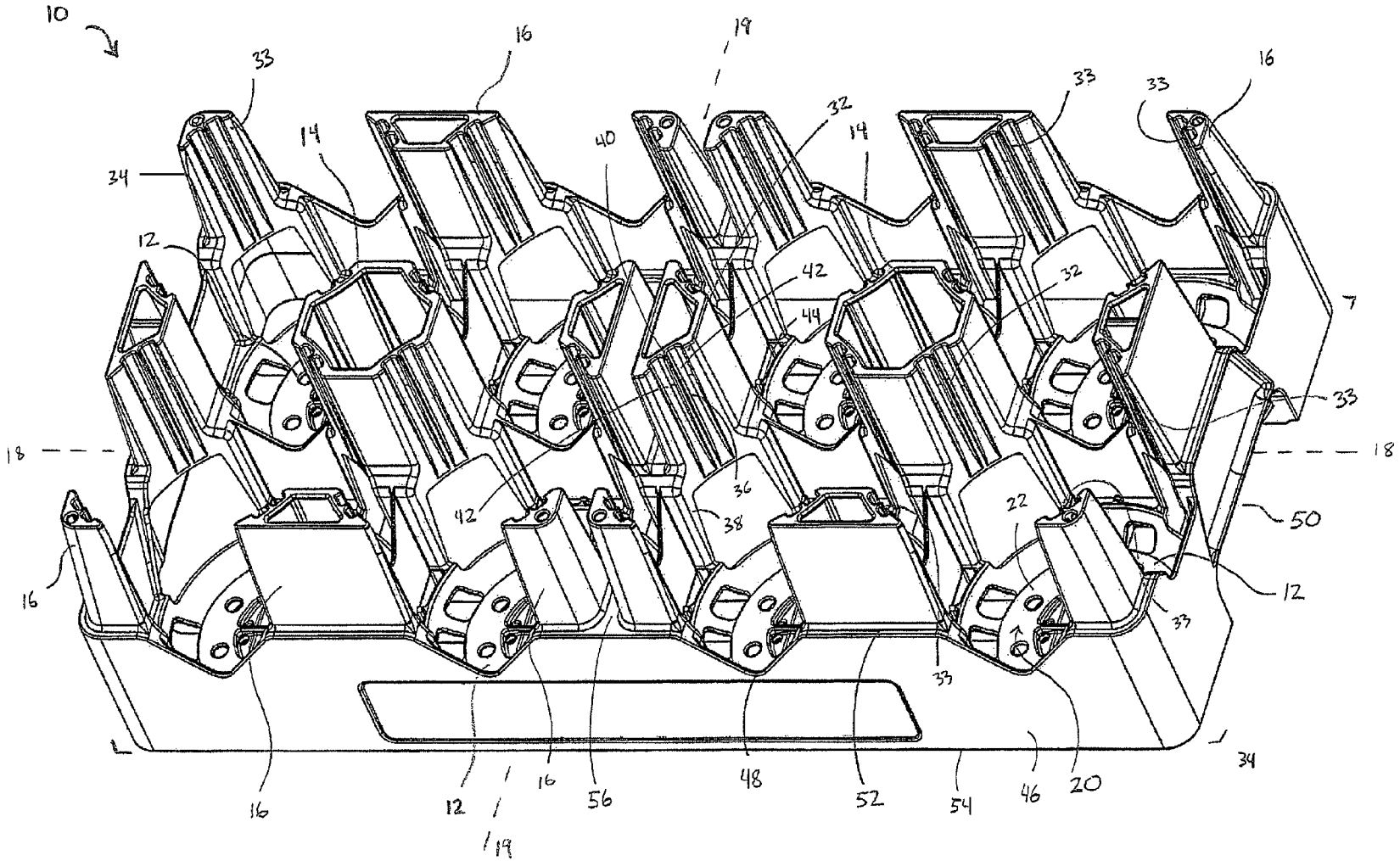
FIG. 1 is a perspective view showing an exemplary embodiment of the beverage crate of the present invention.

Reference will now be made in detail to the present preferred embodiments of the invention, examples of which are illustrated in the accompanying drawings.

The beverage crate described in this disclosure may be used for securely holding a predetermined number of beverage bottles during transport or storage. The present invention is particularly suited for securely holding contoured beverage bottles.

An exemplary embodiment of a beverage crate in accordance with the invention is shown in FIGS. 1 through 8 and is designated generally by reference character 10.

Figure 2:
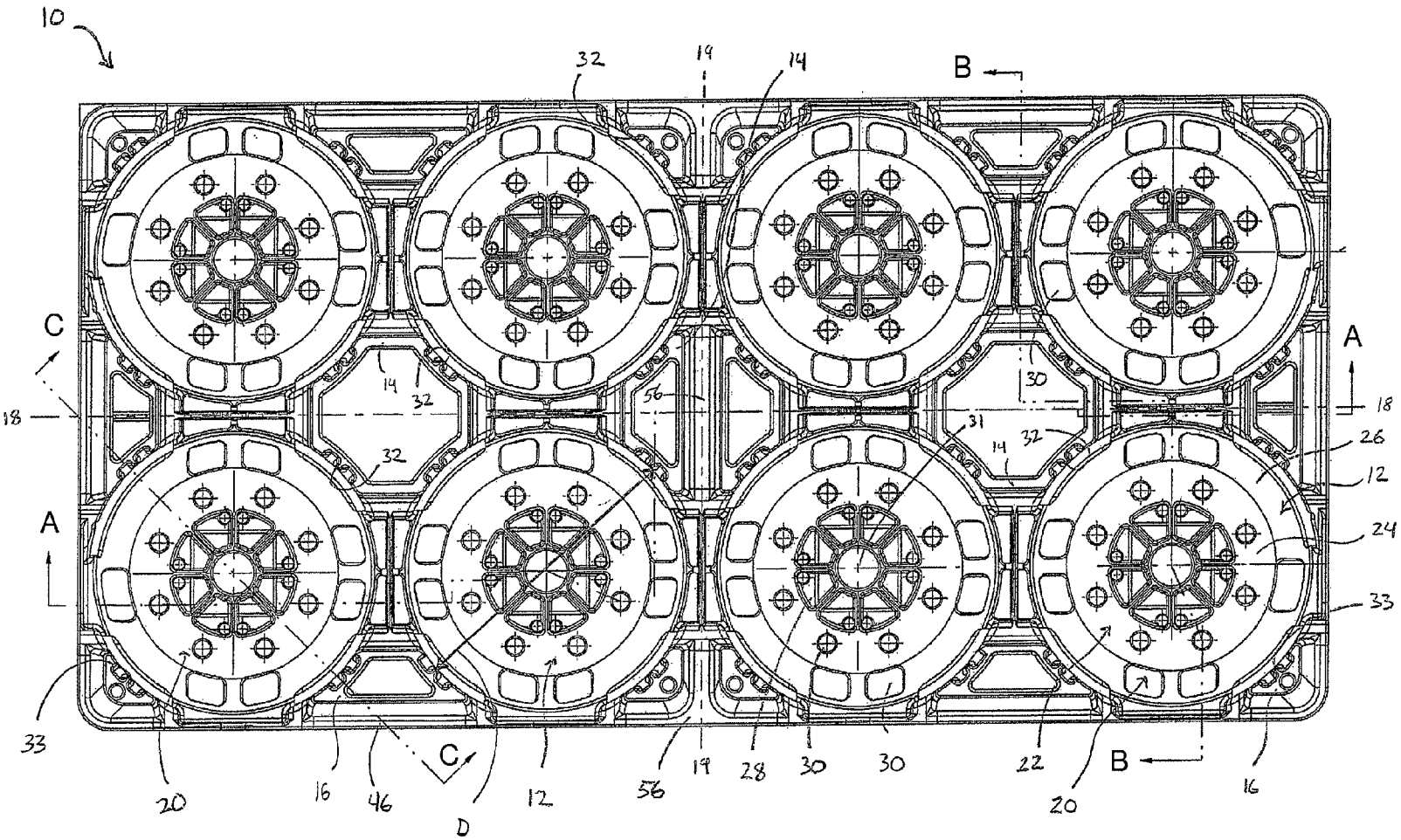
FIG. 2 is a top plan view of the beverage crate of FIG. 1.
Figure 3:
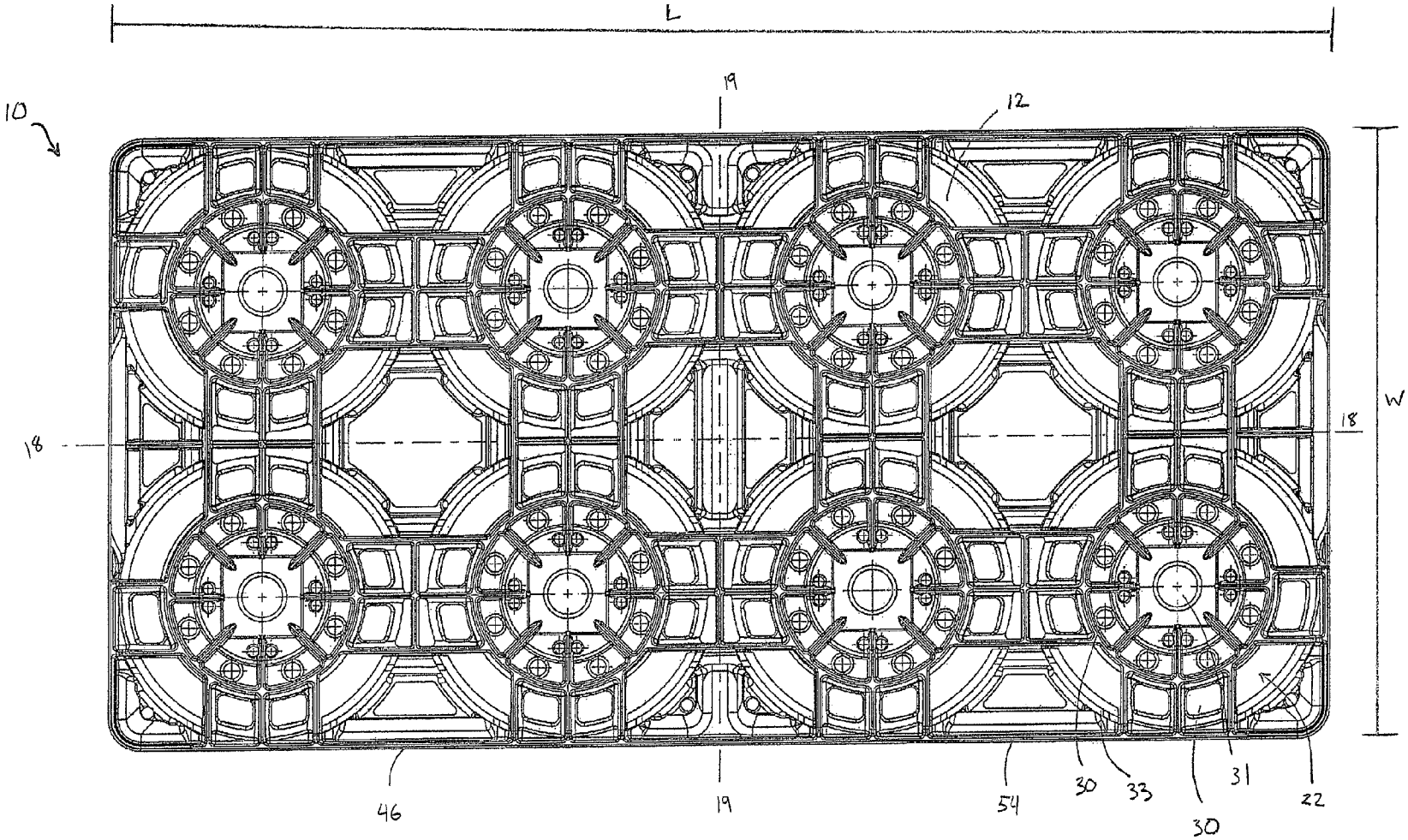
FIG. 3 is a bottom plan view of the beverage crate shown in FIG. 1.
Figure 4:
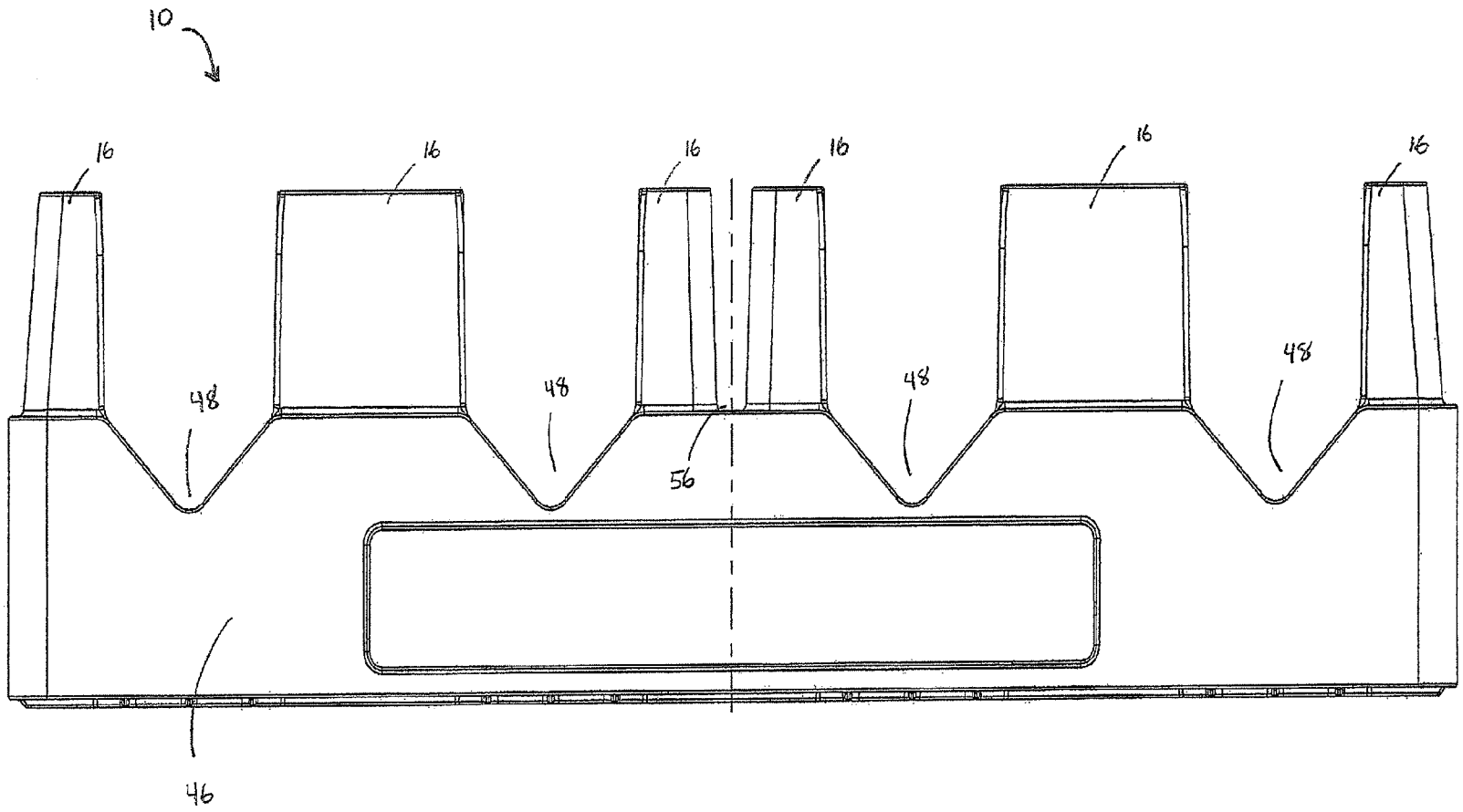
FIG. 4 is a side view along the longitudinal axis of the beverage crate of FIG. 1.

As shown in FIG. 1, crate 10 is preferably integrally molded from a single piece of plastic and includes a floor portion 12, a plurality of central columns 14, and a plurality of pylons 16. The central columns extend upward from floor portion 12 and are positioned along a longitudinal axis or centerline 18 of the crate, which divides the crate into two substantially equal halves. Pylons 16 extend upward from floor portion 12 along the periphery of crate 10. Crate 10 is substantially symmetrical about longitudinal axis 18 as well as about a transverse axis 19. As shown in FIGS. 2 and 3, central columns 14 and pylons 16 are substantially hollow to allow the respective columns and pylons of an identical crate 10 to nest within the columns and pylons when the empty crates are stacked one on top of the other.

As shown in FIGS. 1-3, central columns 14 and pylons 16 include a plurality of bottle contacting surfaces. Preferably, each central column 14 has at least one first bottle contacting surface 32, and each pylon 16 has at least one second bottle contacting surface 33. Central columns 14 may be octagonal in shape while pylons 16 may be trapezoidal or triangular in shape. Octagonal central columns 14 include four bottle contacting surfaces 32, the trapezoidal pylons 16 include two bottle contacting surfaces 33, and the triangular pylons, located on the corners of crate 10, have only one bottle contacting surface 33.

Figure 6:
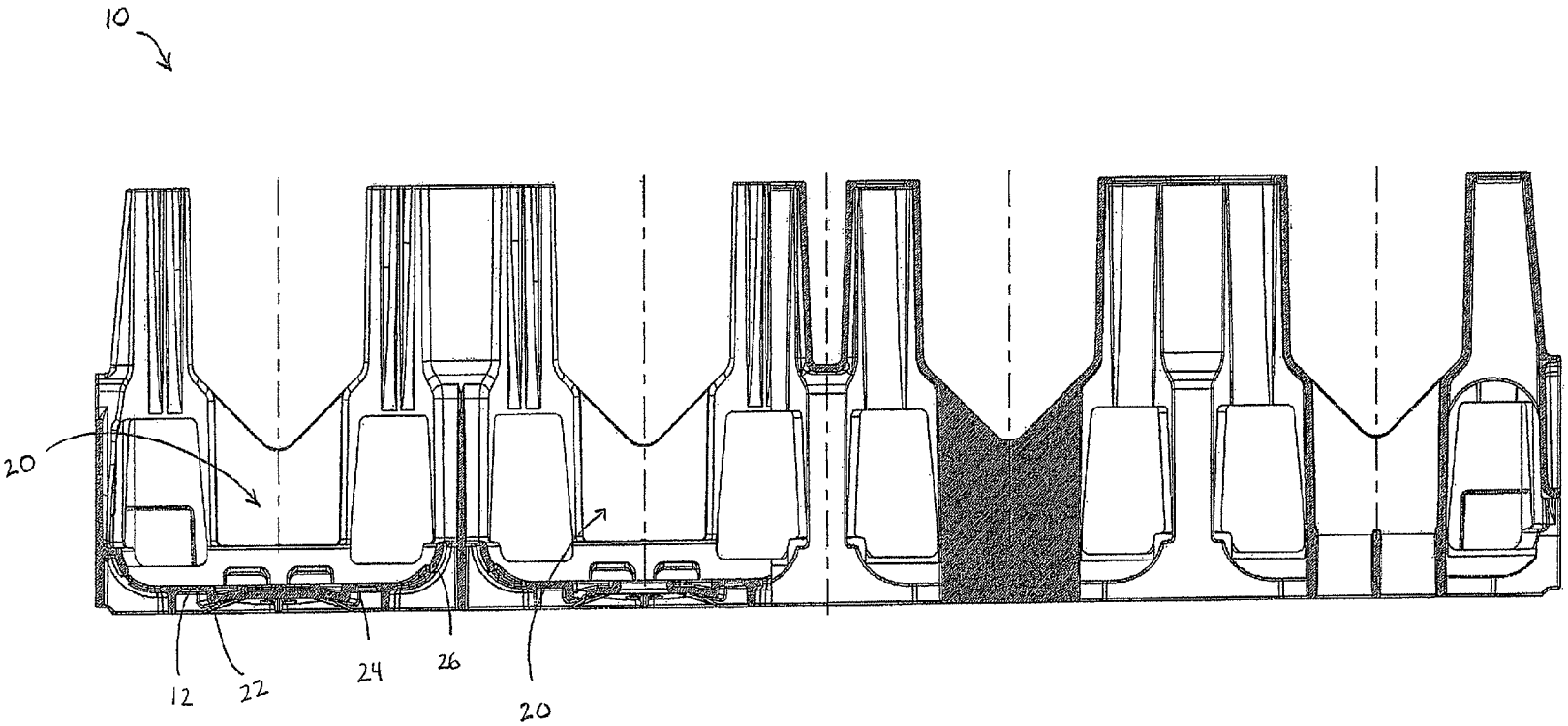
FIG. 6 is a sectional view taken along the line A-A in FIG. 2.
Figure 7:
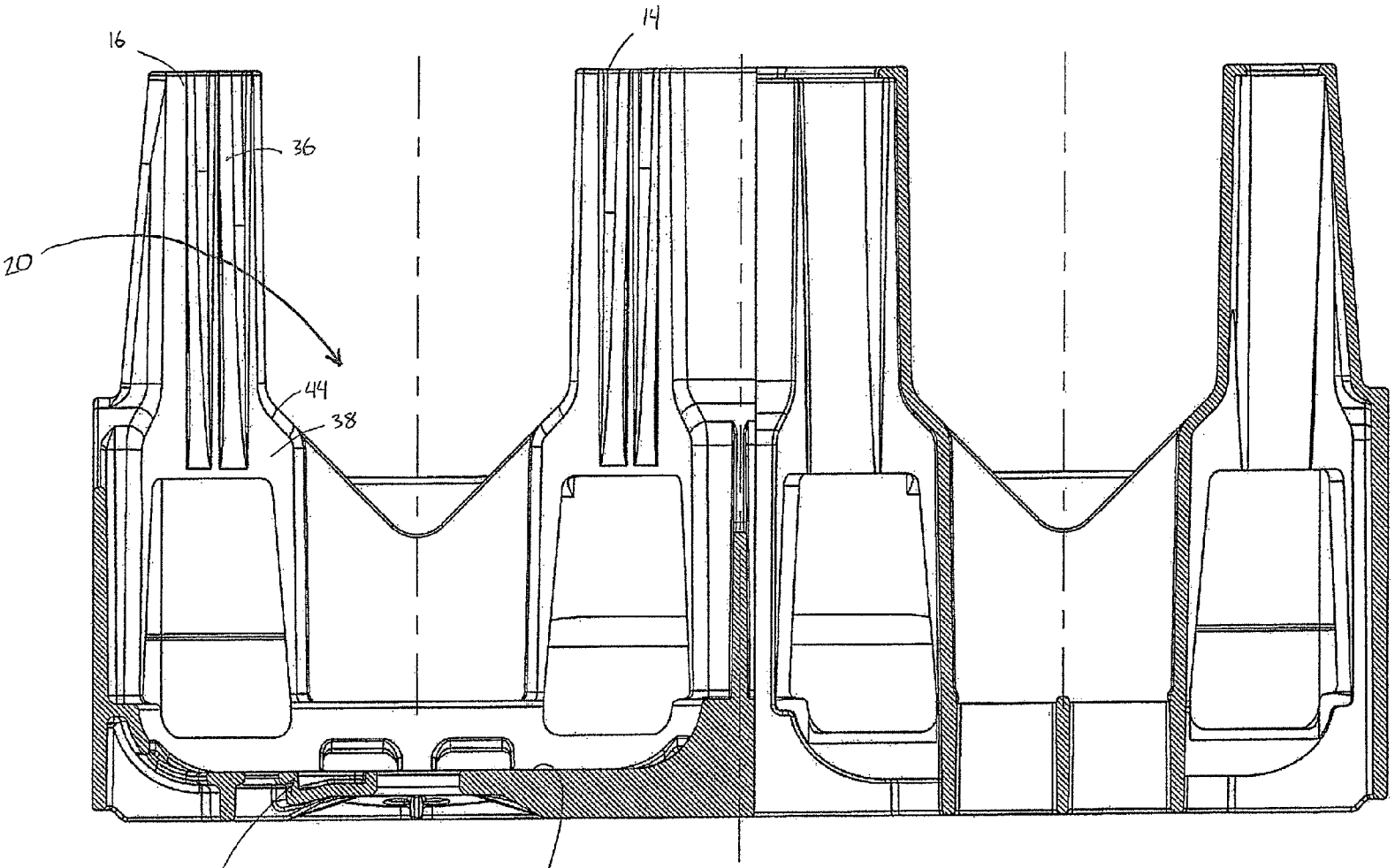
FIG. 7 is a sectional view taken along the line B-B in FIG. 2.

As shown in FIG. 2, floor portion 12, together with bottle contacting surfaces 32, 33 of central columns 14 and pylons 16 form a plurality of pockets 20 for securely holding bottles, for example, commercially available plastic beverage bottles. Floor portion 12 includes a plurality of bottle seating areas 22 adapted to receive a lower portion of a bottle. Bottle seating areas 22 may be of any shape, and preferable are configured to match the geometry of the bottles that crate 10 is intended to hold. Each bottle seating area 22 as shown is generally dish-shaped, with a substantially flat portion 24 surrounded by an upwardly concaved portion 26, as shown in FIGS. 2 and 6. Bottle seating areas 22 may also be generally circular in shape. Crate 10 may include a plurality of recesses 28 and apertures 30 formed in one or more of the bottle seating areas 22. Each bottle seating area 22 may be circular in shape, with a central aperture 31 in the center of each bottle seating area. Central aperture 31 may be surrounded by a plurality of recessed portions 28. Recessed portions 28 may be disposed in flat portion 24 of bottle seating area 22 and arranged radially around central aperture 31. Additional apertures 30 may be present in either the flat portion 24 or the upwardly concaved portion 26 of bottle seating areas 22. The additional apertures may be of any suitable shape.

As shown in FIG. 2, apertures 30 may include a plurality of circular apertures disposed in flat portion 24 of bottle seating area 22 and radially spaced in a symmetric manner around central aperture 31. Apertures 30 may also include a plurality of rectangular apertures disposed in upwardly concaved portion 26 of bottle seating area 22. The dish-like shape of bottle seating areas 22 allows crate 10 to accommodate a wide variety of bottle shapes, including bottles having a relatively planar bottom surface as well as bottles having a petaloid bottom surface. The dish-like shape of bottle seating areas 22 provides greater stability when compared with other designs with only a flat surface for receiving the bottom portion of a bottle.

Figure 8:
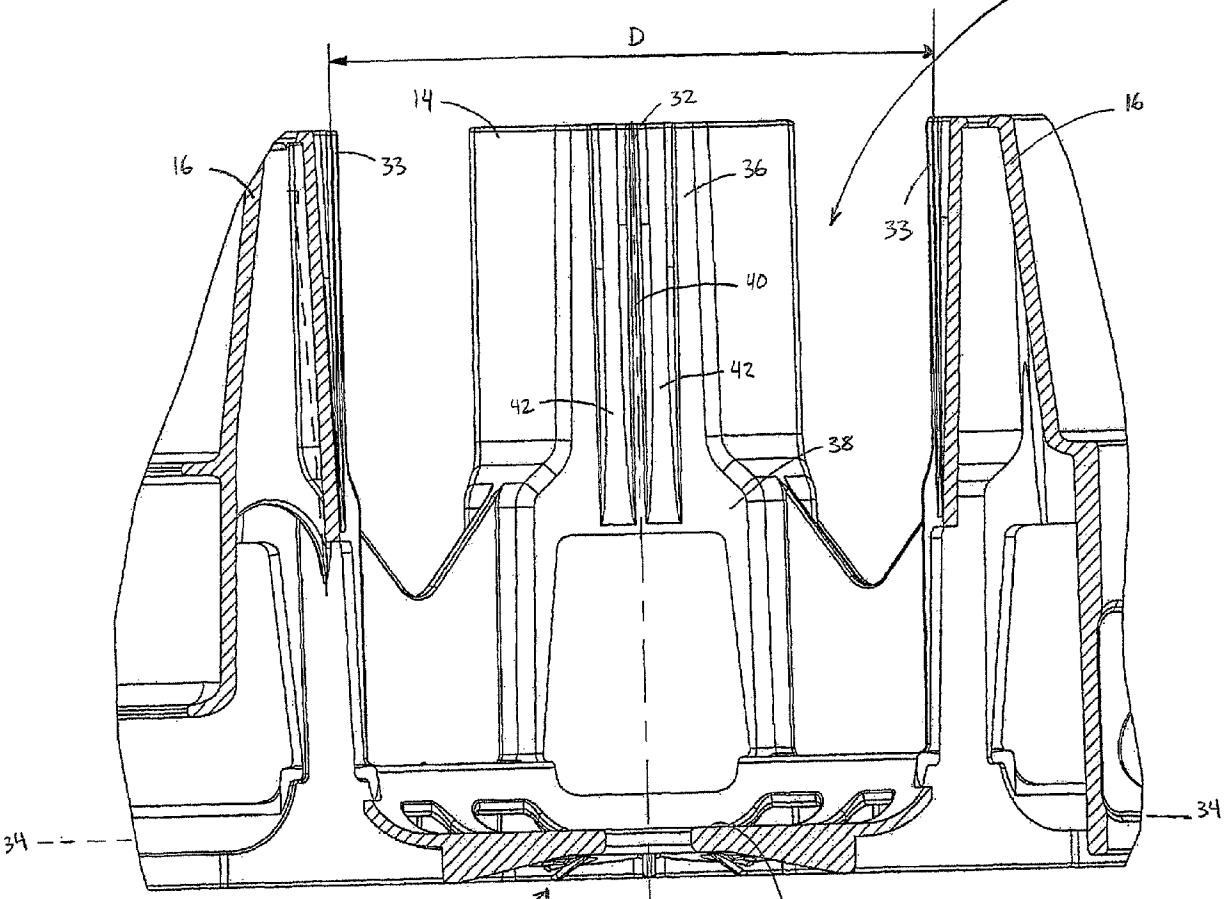
FIG. 8 is a sectional view taken along the line C-C in FIG. 2.

As illustrated in FIG. 8, each pocket 20 for holding bottles is defined by one of the bottle seating areas 22, at least one central column 14, and at least one peripheral pylon 16. Each bottle contacting surface 32, 33 may be a continuous wall, or may be a series of discrete surfaces. Each pocket 20 may be formed by a bottle seating area 22 and any combination of first and second bottle contacting surfaces 32, 33. For example, as shown FIG. 1, pocket 20 may be defined by one first bottle contacting surface 32 located on a central column 14, and three second bottle contacting surfaces 33, with each bottle contacting surface 33 being located on a separate pylon 16. Bottle contacting surfaces 32, 33 function to securely hold the sides of a bottle in place while a bottom portion of the bottle rests on bottle seating area 22.

The flat portions 24 of bottle seating areas 22 are substantially coplanar—that is, the top surface of the flat portions 24 of bottle seating areas 22 are located in the same plane 34 as the other flat portions 24. When crate 10 sits on a flat, level surface such as a floor, flat portions 24 will be substantially parallel to the floor.

Each bottle contacting surface 32, 33 is preferably orthogonal to plane 34, that is, bottle contacting surfaces 32, 33 are oriented at a 90 degree angle with respect to the flat portions 24 of the bottle seating areas 22. Bottle contacting surfaces 32, 33 are orthogonal to plane 34 throughout the axial length of the bottle contacting surface. Bottle contacting surfaces 32, 33 may also be substantially orthogonal to plane 34. Substantially orthogonal means that the bottle contacting surfaces are oriented at approximately a 90° angle (plus or minus about two degrees) with respect to plane 34. Because the bottle contacting surfaces 32 are oriented at a 90° angle with respect to plane 34, pockets 20 formed by bottle contacting surfaces 32 have a constant diameter D (as illustrated in FIGS. 2 and 8) throughout their axial length, the axial length being measured in a direction perpendicular to plane 34. Conventional beverage crates have columns that are drafted, that is, angled either inwardly or outwardly, so that the diameter at the top of a beverage pocket differs substantially from the diameter at the bottom of the pocket.

In contrast to conventional beverage crates, the configuration of crate 10 advantageously allows bottle contacting surfaces to maintain contact with the bottle throughout the axial length of the bottle, allowing the bottles to be more securely held within beverage crate 10. This configuration also makes crate 10 suitable for carrying bottles having a wide variety of shapes, since bottle contacting surfaces 32 engage and securely hold the bottle at both the bottom and the top of the bottle. For example, crate 10 is ideally suited for holding bottles that are contoured, with a waist portion that is smaller in diameter than both a top potion and a bottom portion of the bottle.

As shown in FIGS. 1 and 8, bottle contacting surfaces 32 may include an upper portion 36 and a lower portion 38.

Upper portion 36 may be curved about a central axis extending upward from the center of pocket 20 to correspond to the diameter of the bottle that is to be held within pocket 20. Lower portion 38 may also be curved and may have a width, as measured along the diameter of pocket 20, that is greater than the width of upper portion 36. Lower portion 38 may be substantially open, that is, lower portion 38 may have an aperture to reduce the weight and material costs of crate 10. Upper portion 36 may include a rib 40 extending along a portion of the axial length of the column 14 or pylon 16. Rib 40 may be surrounded by grooves 42 having variable depths. For example, grooves 42 may have a depth that gradually decreases along the axial length of upper portion 36 of bottle contacting surface 32, 33, as shown in FIG. 8.

Upper portion 36 and lower portion 38 correspond to upper and lower portions on columns 14 and pylons 16. The transition between upper portion of the columns and lower portion of the columns includes a stepped surface 44. Stepped surface 44 is angled with respect to plane 34. For example, stepped surface 44 may be at an angle of approximately 45° with respect to plane 34.

Crate 10 also includes a peripheral wall 46 surrounding floor portion 12 and extending upward from the floor portion. Pylons 16 may form part of peripheral wall 46. Peripheral wall 46 may include a plurality of notches 48 formed between adjacent pylons 16. Notches 48 decrease the material needed to form crate 10, thus decreasing weight and cost. In addition, notches 48 provide for increased product visibility for display purposes. Notches 48 may be of any suitable shape, including u-shaped or v-shaped.

Figure 5:
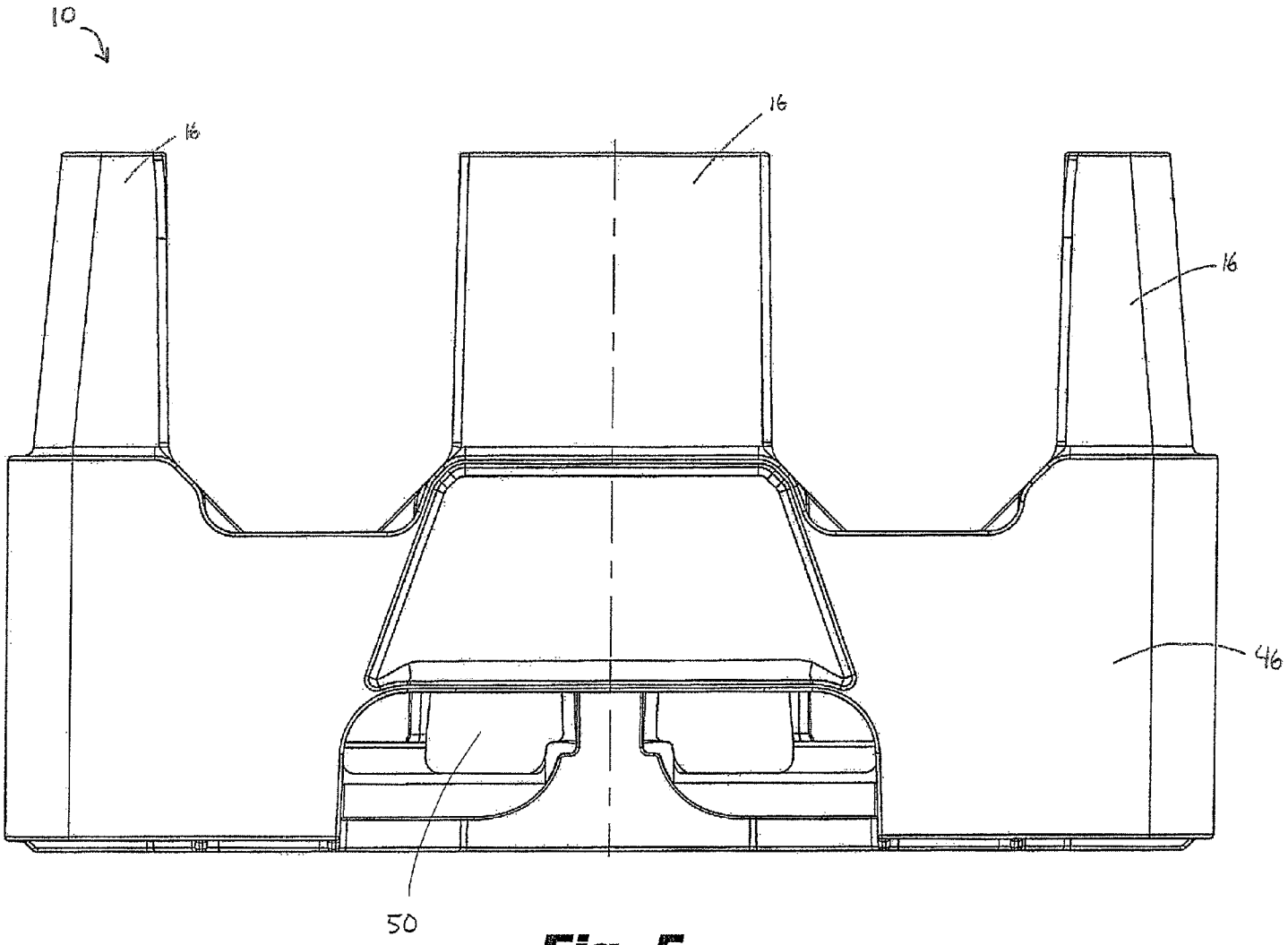
FIG. 5 is a side view along the transverse axis of the beverage crate of FIG. 1.

As shown in FIG. 5, crate 10 may also include a plurality of handle apertures 50 formed on opposing lateral sides of peripheral wall 46. Handle apertures 50 may be formed on opposite ends of the longitudinal axis 18 of crate 10. Handle apertures 50 may be molded to fit the contours of a hand to facilitate grip.

Crate 10 may be of any suitable shape and size. As illustrated in FIGS. 1-5, crate 10 may be rectangular in shape with a length measured along longitudinal axis 18 and a depth measured along transverse axis 19. Crate 10 may be substantially symmetrical about both the longitudinal axis 18 and transverse axis 19. As shown in FIG. 3, the width W of crate 10, as measured along transverse axis 19, is equal to about one half of the length L of the crate, as measured along the longitudinal axis 18.

Crate 10 also includes a central channel 56 that extends along transverse axis 19 of the crate and divides the crate into two substantially identical portions. Advantageously, this allows a plurality of crates 10 to be stacked directly on top of one another or to be cross-stacked. Cross-stacking generally involves stacking rectangular crates in a layered structure, with each layer having crates oriented parallel to each other and with the crates in adjacent layers being oriented at right angles to one another. This configuration helps prevent lateral movement during transport of the empty crates and thus enhances stability. Peripheral wall 46 of crate 10 may include a top surface that forms a ledge 52 for receiving a lower portion 54 of peripheral wall 46 of an identical crate 10 in either a stacked or a cross-stacked configuration. In a cross-stacked configuration, central channel 56 accommodates abutting peripheral walls 46 of additional crates 10, allowing a plurality of crates to be stacked in such a way that the longitudinal axes of the respective crates are oriented at right angles to each other.

The height of central columns 14 and pylons 16 is generally greater than the height of similar structures in conventional beverage crates. The higher columns and pylons increase the stability of crate 10 by providing increased support to the beverage bottles held within the crate. Although the height of columns 14 and 16 are greater than those of conventional crates, the nesting interval remains unchanged. This is accomplished by allowing the columns 14 and pylons 16 to nest deeper within the hollow columns 14 and pylons 16 of a stacked crate. As a result, crate 10 provides for greater stability and safety without increasing the amount of space needed to store and/or transport the crates, either empty or full of product.

Crate 10 can have an overall height of approximately 5.12 inches, with the height of peripheral wall 46 being approximately 3 inches and the height that columns 14 and pylons 16 extend above peripheral wall 46 being approximately 2.12 inches. Crate 10 can have a nesting interval of 3 inches, since stacking a plurality of crates 10 one on top of the other would increase the overall height of the stack by only 3 inches for each additional crate in the stack.

The present invention, as described above and shown in the drawings, provides for a nestable and cross-stackable beverage bottle crate capable of securely holding beverage bottles of varying sizes and shapes. It will be apparent to those skilled in the art that various modifications and variations can be made in the disclosed invention without departing from the scope of the invention as set forth in the appended claims and their equivalents.

I claim:

1. A crate for holding a plurality of beverage bottles comprising:

a floor portion;

a peripheral wall extending upward from the floor portion;

a plurality of pockets forming seating areas for receiving bottles;

a plurality of pylons extending upward from the floor portion, each pylon forming part of the peripheral wall;

a first interior column extending upward from the floor portion, the first interior column having an octagonal cross-sectional shape and a hollow interior portion extending from the floor portion to proximate a top portion of the first interior column, and an opening at the top portion of the first interior column;

a plurality of spaced notches formed in the peripheral wall; and, a plurality of outer ledge portions positioned between the plurality of spaced notches, each outer ledge portion including a flat horizontal surface configured to receive a lower portion of a peripheral wall of an identical crate.

2. The crate of claim 1 further comprising a second interior column spaced from the first interior column extending upward from the floor portion, the second interior column having an octagonal cross-sectional shape and a hollow interior portion extending from the floor portion to proximate a top portion of the second interior column, and an opening at the top portion of the second interior column.

3. The crate of claim 1 wherein the plurality of notches are V-shaped.

4. The crate of claim 1 wherein the plurality of notches are U-shaped.

5. The crate of claim 1 wherein each of the plurality of ledge portions are formed in a corresponding one of the plurality of pylons.

6. The crate of claim 5 wherein each of the plurality of pylons extend upward above the ledge portions.

7. The crate of claim 1 wherein each of the plurality of pockets for receiving bottles is circular.

8. The crate of claim 1 wherein each of the plurality of pockets for receiving bottles includes a central substantially flat portion.

9. The crate of claim 8 wherein each of the plurality of pockets for receiving bottles includes an upwardly concave portion surrounding the central substantially flat portion.

10. The crate of claim 9 wherein each of the seating areas includes a plurality of recesses and apertures.

11. A crate for holding a plurality of beverage bottles comprising:

a generally rectangular floor portion having a first side, an opposing second side, a first end and an opposing second end;

a first side wall portion extending upward from the floor portion along the first side of the floor portion, and a second side wall portion extending upward from the floor portion along the second side of the floor portion;

a first pylon extending upward from the floor portion forming a first part of the first side wall and a second pylon extending upward from the floor portion forming a second part of the first side wall, the first pylon in the first side wall spaced apart from the second pylon in the first side wall;

a plurality of dish-shaped seating areas for receiving bottles, each seating area having a substantially flat portion surrounded by an upwardly concave portion;

a first notch in the first side wall between the first pylon in the first side wall and the second pylon in the first side wall; and, a first outer ledge portion having a flat horizontal upper surface in the first pylon in the first side wall and a second outer ledge portion having a flat horizontal surface in the second pylon in the first side wall, wherein the flat horizontal upper surface of the first outer ledge portion is coplanar with the flat horizontal upper surface of the second outer ledge portion.

12. The crate of claim 11 further comprising a plurality of pockets forming the plurality of seating areas for receiving bottles.

13. The crate of claim 12 further comprising:

a first pylon extending upward from the floor portion forming a first part of the second side wall and a second pylon extending upward from the floor portion forming a second part of the second side wall, the first pylon in the second side wall spaced apart from the second pylon in the second side wall;

a first notch in the second side wall between the first pylon in the second side wall and the second pylon in the second side wall; and, a first outer ledge portion in the first pylon in the second side wall and a second outer ledge portion in the second pylon in the second side wall.

14. The crate of claim 11 wherein the first notch is V-shaped.

15. The crate of claim 11 wherein the first notch is U-shaped.

16. The crate of claim 13 further comprising:

a first end wall extending upward from the floor portion along the first end; and, a second end wall extending upward from the floor portion along the second end.

17. The crate of claim 16 further comprising a plurality of interior columns extending upward from the floor portion.

18. The crate of claim 17 wherein each of the plurality of interior columns has an octagonal cross-sectional shape and a hollow interior portion extending from the floor portion to proximate a top portion of the column.

19. The crate of claim 18 wherein each of the plurality of interior columns includes an opening at the top portion of the column.

20. The crate of claim 11 wherein each of the seating areas includes a plurality of recesses and apertures.

* * * * *